US006879227B2

(12) United States Patent
Bach et al.

(10) Patent No.: US 6,879,227 B2
(45) Date of Patent: Apr. 12, 2005

(54) SWITCHING CONTACT ARRANGEMENT

(75) Inventors: Michael Bach, Berlin (DE); Detlev Schmidt, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/467,935

(22) PCT Filed: Feb. 7, 2002

(86) PCT No.: PCT/DE02/00485

§ 371 (c)(1),
(2), (4) Date: Aug. 14, 2003

(87) PCT Pub. No.: WO02/065494

PCT Pub. Date: Aug. 22, 2002

(65) Prior Publication Data

US 2004/0066257 A1 Apr. 8, 2004

(30) Foreign Application Priority Data

Feb. 14, 2001 (DE) ..... 101 08 858

(51) Int. Cl.[7] ..... H01H 75/00
(52) U.S. Cl. ..... 335/16; 335/147
(58) Field of Search ..... 335/6, 16, 147, 335/185–195, 165–176, 202; 200/244, 275; 218/22

(56) References Cited

U.S. PATENT DOCUMENTS

| | | | | |
|---|---|---|---|---|
| 3,646,488 A | * | 2/1972 | Iida et al. | 335/16 |
| 4,853,662 A | * | 8/1989 | Kandatsu | 335/185 |
| 5,359,161 A | | 10/1994 | Leach et al. | |
| 5,469,121 A | | 11/1995 | Payet-Burin | |
| 5,517,164 A | | 5/1996 | Zoller et al. | |
| 5,874,874 A | * | 2/1999 | Helms et al. | 335/16 |

* cited by examiner

*Primary Examiner*—Lincoln Donovan
(74) *Attorney, Agent, or Firm*—Harness, Dickey & Pierce, P.L.C.

(57) ABSTRACT

A switching contact includes a rocker-type leaf spring as a contact force spring in order to produce the contact force required for a contact lever A drag bearing thereof is disposed between the point of rotation of the contact lever on a contact carrier and a contact-making end piece of the contact lever. Preferably, the drag bearing is formed by a bend of the contact force spring and a sliding surface disposed on the contact carrier. The drag bearing of the contact force spring can be displaced without a fixed link along the sliding surface according to the tension of the contact force spring. If the switching contract arrangement has several contact levers (multiple contact arrangement) all of the associated contact force springs can be combined to form a one-piece leaf spring.

61 Claims, 2 Drawing Sheets

II - II

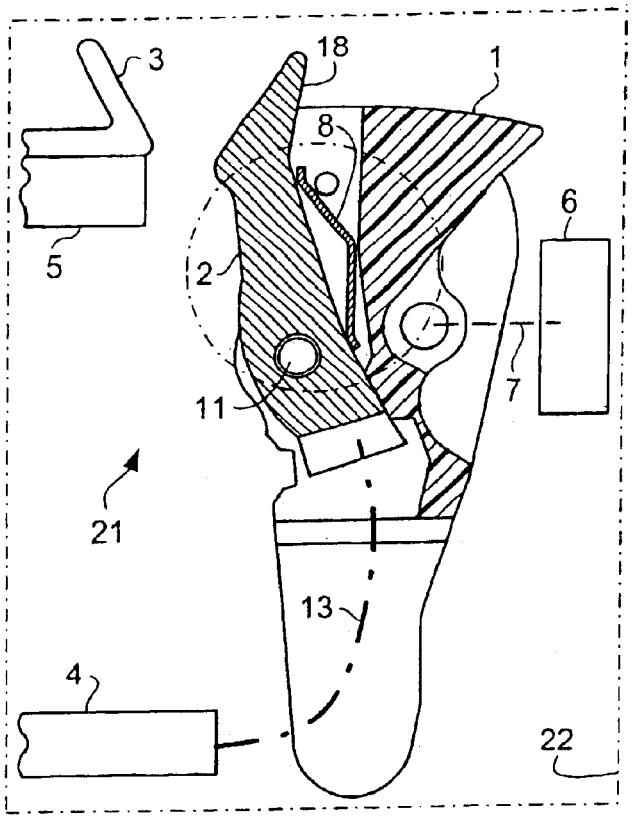
FIG 1 II - II
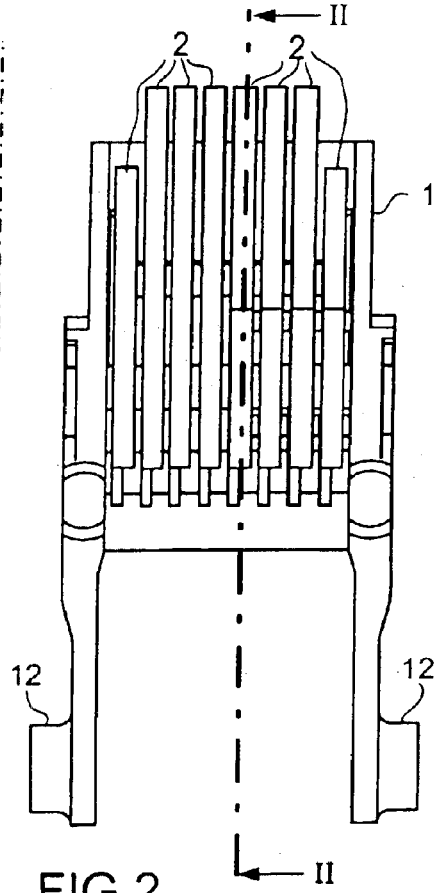
FIG 2
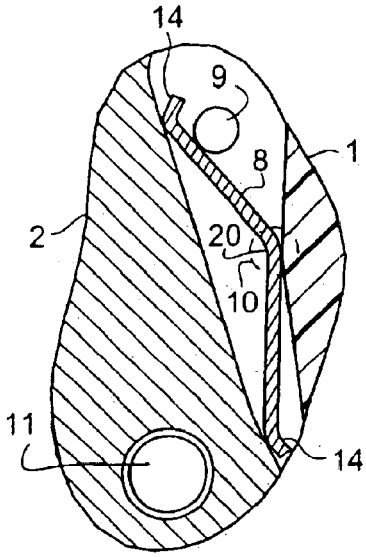
FIG 3

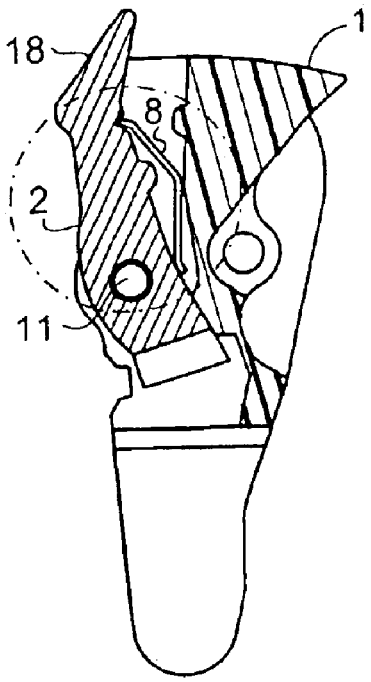
FIG 4 V - V
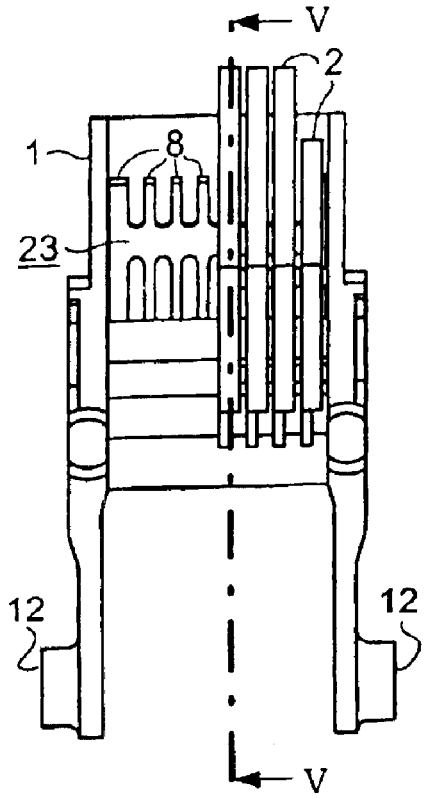
FIG 5
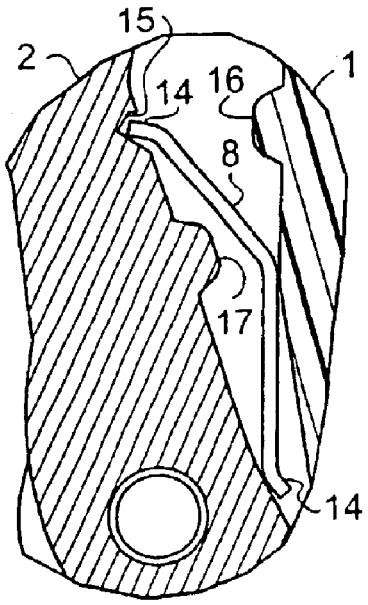
FIG 6
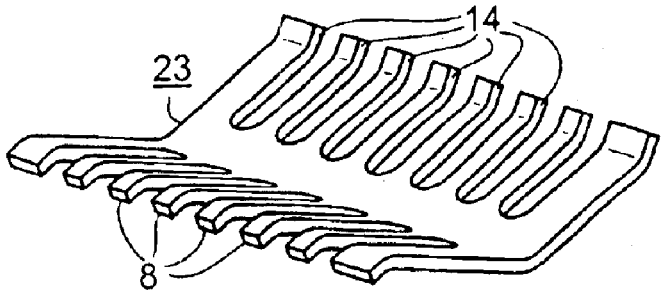
FIG 7

SWITCHING CONTACT ARRANGEMENT

This application is the national phase under 35 U.S.C. § 371 of PCT International Application No. PCT/DE02/00485 which has an International filing date of Feb. 7, 2002, which designated the United States of America and which claims priority on German Patent Application number DE 10108858.2 filed Feb. 14, 2001, the entire contents of which are hereby incorporated herein by reference.

FIELD OF THE INVENTION

The present invention generally relates to a switching contact arrangement. Preferably, it relates to one including a contact mount and a contact lever which can move in an articulated manner about a rotation point on the contact mount, as well as a contact force spring, preferably in the form of a leaf spring, for pressing the contact lever against an opposing contact.

BACKGROUND OF THE INVENTION

A switching contact arrangement has been disclosed as a component of a low-voltage circuit breaker in U.S. Pat. No. 5,517,164.

The contact force which acts on the switching contacts of circuit breakers is applied by stressing the contact force springs which have been mentioned, during the connection process. This is done by way of a drive apparatus which is part of the circuit breaker and whose switching movement is essentially constant throughout the intended life of the circuit breaker. In contrast, erosion of the switching contacts increases the travel of the contact lever, so that the contact force decreases in a corresponding manner to the erosion. If the aim is to ensure that an adequate contact force is achieved even toward the end of the life of a switching contact arrangement, appropriate design of the contact force springs can lead to an undesirably high contact force when their switching contact arrangement is new. This results in a correspondingly large amount of energy being required for the drive apparatus.

SUMMARY OF THE INVENTION

An embodiment of the present invention is based on an object of specifying a circuit breaker in which the contact force depends to a lesser extent on erosion of the contacts.

In the case of a switching contact arrangement of the type mentioned initially, an embodiment of the invention, achieves an object in that the contact force spring is arranged such that it can pivot like a rocker, such that the ends of the contact force spring rest on the contact lever, and a pivoting bearing of the contact force spring is arranged between the rotation point of the contact lever and its contact-making end part.

The contact force of the switching contact arrangement according to an embodiment of the invention does not follow the known characteristic of a helical compression spring or of a single-armed leaf spring according to the cited U.S. Pat. No. 5,517,164. In fact, the dependency on the contact erosion is largely reduced, and can largely be overcome by optimized design of the geometry. The contact force is essentially defined by suitable choice of the prestresses. This also avoids the necessity to derate the contact force spring and the drive apparatus, which has an advantageous effect on the life of the circuit breaker.

The pivoting bearing of the contact force spring can preferably move along a sliding surface, which is located on the contact mount, as a function of the respective spring force without any fixed connection to the contact mount. The bearing point of the leaf spring arrangement varies as a function of the position of the contact lever, since it is not supported in a fixed position.

It has been found to be advantageous for the pivoting bearing for a contact force spring to be formed by a bend, which rests on the essentially planar sliding surface on the contact mount, in the contact force spring.

In order to ensure that a defined force acts despite the fact that the pivoting bearing of the contact force spring can move relative to the contact support, it is recommended that the relative movement of the contact force spring with respect to the contact lever be restricted, or be related to a specific point. This can be achieved by providing a sliding core, which is seated on the contact mount as an opposing bearing for the contact force spring. It has also been found to be equally suitable, in order to form an opposing bearing for the contact force spring, for one end of it to be bent, and for a recess to be arranged on the contact lever in order to hold the bent end.

As mentioned in the introduction, the subject matter of an embodiment of the invention includes the need to keep low the energy required to operate the switching contact arrangement of a circuit breaker. This can be contributed to by providing projections which are opposite one another with offset on the contact mount and on the contact lever in an arrangement, such that the spring force during connection of the switching contact arrangement rises toward the end of the connection movement. Thus, the drive force to be provided by a drive apparatus rises less steeply when the contact lever is in contact with the opposing contact and even available kinetic energy can be used to achieve the required stress on the contact force springs when the switching contact arrangement is in the connected state.

The embodiment of a switching contact arrangement according to an embodiment of the invention is particularly suitable for circuit breakers with a high rated current, which have two or more contact levers in each pole. The production and the assembly of the corresponding number of contact force springs can be simplified by the contact force springs of all the contact levers being a component of an integral leaf spring.

BRIEF DESCRIPTION OF THE DRAWINGS

The invention will be explained in more detail in the following text with reference to exemplary embodiments which are illustrated in the figures.

FIG. 1 shows a switching contact arrangement having two or more contact levers, partially in the form of a section II—II in FIG. 2.

FIG. 2 shows the switching contact arrangement as shown in FIG. 1, looking at the parallel contact lever.

FIG. 3 shows a detail of the switching contact arrangement, shown on an enlarged scale, as in FIGS. 1 and 2.

FIGS. 4, 5 and 6 show a further exemplary embodiment, in illustrations which correspond to FIGS. 1, 2 and 3.

FIG. 7 shows a leaf spring which has contact force springs for two or more contact levers, illustrated in perspective.

DETAILED DESCRIPTION OF THE PREFERRED EMBODIMENTS

The switching contact arrangement which is illustrated in FIGS. 1, 2 and 3 includes a contact mount 1 which is mounted by way of bearing pins 12 in pivoting bearings which are not shown. Contact levers 2 are connected to the contact mount 1, articulated about a rotation point 11. The contact levers 2 have a contact-making end part 18 and are electrically conductively connected to a lower connecting rail 4 at the opposite end by way of flexible conductors 13, which are merely indicated. Contact force springs 8 which are mounted like rockers are located between the contact mount 1 and the contact levers 2 and ensure that the contact-making end parts 18 of the contact levers 2 rest against an opposing contact 5, which is fitted with an arcing horn 3, with an adequate contact force when the switching contact arrangement is in the connected state. The opposing contact 5 may be formed in a known manner by one end of an upper connecting rail, which his arranged parallel to the lower connecting rail 4.

FIG. 1 furthermore shows, schematically, a drive apparatus 6 which is known per se, acts by way of a lever chain 7 on the contact mount 1, and moves the latter to the connected or disconnected position. Together with the protection and control devices that are not shown, said assemblies form a low-voltage circuit breaker 22, as indicated by a dash-dotted frame.

The contact force springs 8 of the individual contact levers 2 may admittedly be individual parts in the form of leaf springs, but are a component of a cohesive leaf spring, that is to say an integral leaf spring. As can be seen in more detail in FIGS. 1 and 3, the contact force springs 8 may have a bend 20 which is arranged approximately in the center and which, together with a sliding surface 19 is formed on the contact mount 1, forms a pivoting bearing 10. The essential feature for the desired operation of the switching contact arrangement is the position of the pivoting bearing 10 between the rotation point 11 of the contact lever 2 and an upper end limb 14 of the contact force spring 8. This end limb 14 rests on the contact-making end part 18 of the contact lever 2, while an end limb 14, whose shape is approximately the same, rests on the contact lever 2 at the opposite end of the contact force spring 8, approximately where the rotation point 11 is located. This arrangement has the characteristic that the contact force between the contact-making end part 18 and the opposing contact 5 is largely independent of the relative position of the contact lever 2 with respect to the contact mount 1. The influence of the erosion of the interactive contact points on the magnitude of the contact force is thus small.

In order to ensure that the required contact force is produced, the position of the upper angled end part 14 of the contact force spring 8 is a significant factor for given dimensions and characteristics of the interacting parts. A sliding core 9, which is fitted to the contact mount 2, may be provided for this purpose. The pivoting bearing 10 of the arrangement 8 can move freely along the sliding surface 19 without any fixed connection to the contact mount 1, and is limited only by the sliding core 9, which is used as an opposing bearing, as a function of the stress in the contact force spring 8.

It should also be mentioned that the illustrated arrangement of the rocker-like contact force spring 8 may be located in the space between that side of the contact lever 2 which faces away from the contacts and the contact mount 1, and may in this way be protected against influences of switching arcs.

The further embodiment of a switching contact arrangement as illustrated in FIGS. 4 to 7 and having a large number of contact levers 2 (multiple contact system) differs in the features described in the following text from the example illustrated in FIGS. 1 to 3. With regard to the rest of the embodiment, reference should be made to the description of the embodiment according to FIGS. 1 to 3.

While, in the first exemplary embodiment of the invention, the sliding core 9 is used as a device for positioning the rocker-like contact force spring 8, in the second embodiment of the invention as illustrated in FIGS. 4 to 7, the upper end limb 14 is bent in the direction of the contact lever. The contact levers 2 are provided with a recess 15, in which the end limb 14 engages. This results in the contact force springs 8 being aligned with respect to the associated contact levers. As in the exemplary embodiment shown in FIGS. 1, 2 and 3 as well, the desired contact force is achieved by fitting the contact force springs 8 in the switching contact arrangement with a specific prestress.

The embodiment of two or more contact force springs 8 as an integral leaf spring 23 can be seen in more detail in FIGS. 5 and 7. In this case, FIG. 5 shows that the leaf spring 23 is located behind the contact levers. Assembly is easy and may, for example, be carried out such that the leaf spring 23 is pushed into the intermediate space, after the contact mount 1 and contact levers 2 have been joined together, until the angled end parts 14 latch into the recesses 25.

In order to reduce the amount of energy required for connection of a circuit breaker, it may be desirable for the contact force to be increased to a desired value during connection only shortly before the contact lever reaches the final position. As can clearly be seen in FIG. 4 and FIG. 6, projections 16 and 17 are provided on the contact mount 1 and on the contact lever 2, respectively, in order to achieve this aim, are opposite one another with an offset and are arranged such that the spring force is increased toward the end of the connection movement.

LIST OF REFERENCE SYMBOLS

1 Contact mount
2 Contact lever
3 Arcing horn on the opposing contact 5
4 Lower connecting rail
5 Opposing contact
6 Drive apparatus
7 Lever chain
8 Rocker-like contact force spring
9 Sliding core
10 Pivoting bearing for the contact force spring
11 Rotation point of the contact lever 2
12 Pin for a pivoting bearing
13 Flexible strips
14 Angled end limb of the contact force spring 8
15 Recess on the contact lever 2
16 Projection on the contact mount 1
17 Projection on the contact lever 2
18 Contact-making end part of the contact lever 2
19 Sliding surface on the contact mount 1
20 Bend in the contact force spring 8
21 Switching contact arrangement
22 Circuit breaker
23 Leaf spring with two or more contact force springs 8

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching contact arrangement, comprising:

a contact mount;

a contact lever, adapted to move in an articulated manner about a rotation point on the contact mount; and a contact force spring, adapted to exert a force against the contact lever, wherein the contact force spring is arranged to pivot, wherein both ends of the contact force spring rest on the contact lever, and wherein a pivoting bearing of the contact force spring is arranged approximately between the rotation point of the contact lever and a contact-making end part of the contact lever.

2. The switching contact arrangement as claimed in claim 1, wherein the pivoting bearing of the contact force spring is adapted to move along a sliding surface of the contact mount, as a function of the respective spring force, without any fixed connection to the contact mount.

3. The switching contact arrangement as claimed in claim 1, wherein the pivoting bearing of the contact force spring is formed by a bend, resting on an essentially planar sliding surface on the contact mount, in the contact force spring.

4. The switching contact arrangement as claimed in claim 1, further comprising:

a sliding core, seated on the contact mount as an opposing bearing for the contact force spring.

5. The switching contact arrangement as claimed in claim 1, wherein, in order to form an opposing bearing for the contact force spring, one end of the contact spring is bent, and a recess is arranged on the contact lever to hold the bent end.

6. The switching contact arrangement as claimed in claim 1, further comprising:

projections, opposite one another with an offset on the contact mount and on the contact lever, arranged such that a spring force during connection of the switching contact arrangement rises toward the end of the connection movement.

7. The switching contact arrangement as claimed in claim 1, wherein the switching contact arrangement is in the form of a multiple contact arrangement, and wherein the contact force springs of all the contact levers are a component of an integral leaf spring.

8. The switching contact arrangement as claimed in claim 1, wherein the contact force spring is in the form of a leaf spring.

9. The switching contact arrangement as claimed in claim 2, wherein the pivoting bearing of the contact force spring is formed by a bend, resting on the sliding surface on the contact mount, in the contact force spring.

10. The switching contact arrangement as claimed in claim 2, further comprising:

a sliding core, seated on the contact mount as an opposing bearing for the contact force spring.

11. The switching contact arrangement as claimed in claim 3, wherein the pivoting bearing of the contact force spring is formed by a bend, resting on an essentially planar sliding surface on the contact mount, in the contact force spring.

12. The switching contact arrangement as claimed in claim 3, further comprising:

a sliding core, seated on the contact mount as an opposing bearing for the contact force spring.

13. The switching contact arrangement as claimed in claim 2, further comprising:

projections, opposite one another with an offset on the contact mount and on the contact lever, arranged such that a spring force during connection of the switching contact arrangement rises toward the end of the connection movement.

14. The switching contact arrangement as claimed in claim 2, wherein the switching contact arrangement is in the form of a multiple contact arrangement, and wherein the contact force springs of all the contact levers are a component of an integral leaf spring.

15. The switching contact arrangement as claimed in claim 3, further comprising:

projections, opposite one another with an offset on the contact mount and on the contact lever, arranged such that a spring force during connection of the switching contact arrangement rises toward the end of the connection movement.

16. The switching contact arrangement as claimed in claim 3, wherein the switching contact arrangement is in the form of a multiple contact arrangement, and wherein the contact force springs of all the contact levers are a component of an integral leaf spring.

17. The switching contact arrangement as claimed in claim 4, further comprising:

projections, opposite one another with an offset on the contact mount and on the contact lever, arranged such that a spring force during connection of the switching contact arrangement rises toward the end of the connection movement.

18. The switching contact arrangement as claimed in claim 4, wherein the switching contact arrangement is in the form of a multiple contact arrangement, and wherein the contact force springs of all the contact levers are a component of an integral leaf spring.

19. The switching contact arrangement as claimed in claim 5, further comprising:

projections, opposite one another with an offset on the contact mount and on the contact lever, arranged such that a spring force during connection of the switching contact arrangement rises toward the end of the connection movement.

20. The switching contact arrangement as claimed in claim 5, wherein the switching contact arrangement is in the form of a multiple contact arrangement, and wherein the contact force springs of all the contact levers are a component of an integral leaf spring.

21. A switching contact arrangement, comprising:

a contact mount;

a lever, adapted to move about a rotation point on the contact mount; and means for exerting a force against the lever, wherein the means for exerting a force is arranged to pivot, with both ends of the means for exerting a force resting on the lever, and wherein an angled surface of the means for exerting a force is arranged approximately between the rotation point of the lever and a contact-making end part of the lever.

22. The switching contact arrangement as claimed in patent claim 21, wherein a pivoting bearing at the angled surface of the means for exerting a force is adapted to move along a surface of the contact mount, as a function of a respective spring force, without any fixed connection to the contact mount.

23. The switching contact arrangement as claimed in claim 21, wherein a pivoting bearing of the means for exerting a force is formed by a bend in the exerting a force, resting on an essentially planar sliding surface of the contact mount.

24. The switching contact arrangement as claimed in claim 21, further comprising:

a sliding core, arranged on the contact mount as an opposing bearing for the means for exerting a force.

25. The switching contact arrangement as claimed in claim 21, wherein the means for exerting a force includes a spring, and wherein, in order to form an opposing bearing for the spring, one end of the spring is bent, and wherein a recess is arranged in the lever to hold the bent end.

26. The switching contact arrangement as claimed in claim 21, further comprising:

projections, opposite one another with an offset on the contact mount and on the lever, arranged such that a spring force during connection of the switching contact arrangement rises toward the end of the connection movement.

27. The switching contact arrangement as claimed in claim 21, wherein the switching contact arrangement is in the form of a multiple contact arrangement, wherein the means for exerting a force of each contact arrangement includes a spring, and wherein springs of all the levers are a component of an integral leaf spring.

28. The switching contact arrangement as claimed in claim 21, wherein the means for exerting a force includes a leaf spring.

29. A switching contact arrangement, comprising:

a contact mount;

a lever, adapted to move about a rotation point on the contact mount; and means for exerting a force against the lever, wherein the means for exerting a force is arranged to pivot, with both ends of the means for exerting a force resting on the lever, and wherein a pivot bearing of the means for exerting a force is arranged approximately between the rotation point of the lever and a contact-making end part of the lever.

30. The switching contact arrangement as claimed in patent claim 29, wherein the pivoting bearing is adapted to move along a surface of the contact mount, as a function of a respective spring force, without any fixed connection to the contact mount.

31. The switching contact arrangement as claimed in claim 29, wherein the pivoting bearing is formed by a bend in the exerting a force, resting on the essentially planar sliding surface of the contact mount.

32. The switching contact arrangement as claimed in claim 29, further comprising:

a sliding core, arranged on the contact mount as an opposing bearing for the means for exerting a force.

33. The switching contact arrangement as claimed in claim 29, wherein the means for exerting a force includes a spring, and wherein, in order to form an opposing bearing for the spring, one end of the spring is bent, and wherein a recess is arranged in the lever to hold the bent end.

34. A switching contact arrangement, comprising:

a contact mount;

a lever, adapted to move about a rotation point on the contact mount; and a spring, adapted to exert a force against the lever, the spring being arranged to pivot, with both ends of the spring resting on the lever, wherein a pivoting bearing of the spring is arranged approximately between the rotation point of the lever and a contact-making end part of the lever.

35. The switching contact arrangement as claimed in claim 34, wherein the spring is a leaf spring.

36. The switching contact arrangement as claimed in patent claim 34, wherein the pivoting bearing is adapted to move along a surface of the contact mount, as a function of a respective spring force, without any fixed connection to the contact mount.

37. The switching contact arrangement as claimed in claim 34, wherein the pivoting bearing is formed by a bend in the exerting a force, resting on the essentially planar sliding surface of the contact mount.

38. The switching contact arrangement as claimed in claim 34, further comprising:

a sliding core, arranged on the contact mount as an opposing bearing for the spring.

39. The switching contact arrangement as claimed in claim 34, wherein, in order to form an opposing bearing for the spring, one end of the spring is bent, and wherein a recess is arranged in the lever to hold the bent end.

40. The switching contact arrangement as claimed in claim 1, wherein the spring is a contact force spring.

41. A circuit breaker comprising the switching contact arrangement of claim 1.

42. A circuit breaker comprising the switching contact arrangement of claim 21.

43. A circuit breaker comprising the switching contact arrangement of claim 29.

44. A circuit breaker comprising the switching contact arrangement of claim 34.

45. The circuit breaker of claim 41, wherein the switching contact arrangement is mounted, via bearing pins, in pivoting bearings of the circuit breaker.

46. The circuit breaker of claim 42, wherein the switching contact arrangement is mounted, via bearing pins, in pivoting bearings of the circuit breaker.

47. The circuit breaker of claim 43, wherein the switching contact arrangement is mounted, via bearing pins, in pivoting bearings of the circuit breaker.

48. The circuit breaker of claim 44, wherein the switching contact arrangement is mounted, via bearing pins, in pivoting bearings of the circuit breaker.

49. The switching contact arrangement as claimed in claim 21, wherein the lever is adapted to move in an articulated manner about a rotation point on the contact mount.

50. The switching contact arrangement as claimed in claim 29, wherein the lever is adapted to move in an articulated manner about a rotation point on the contact mount.

51. The switching contact arrangement as claimed in claim 34, wherein the lever is adapted to move in an articulated manner about a rotation point on the contact mount.

52. The switching contact arrangement as claimed in claim 34, wherein a first end limb of the spring rests on a contact-making end part of the lever, and a second end limb rests on the lever approximately at the rotation point.

53. The switching contact arrangement as claimed in claim 34, wherein the first end limb of the spring is angled up with respect to the lever.

54. The switching contact arrangement as claimed in claim 34, further comprising a sliding core, fitted to the contact mount, wherein the first end limb of the spring is adapted to move between the sliding core and the lever.

55. The switching contact arrangement as claimed in claim 54, wherein the pivoting bearing of the spring is adapted to move along a surface of the contact mount, and is limited only by the sliding core.

56. The switching contact arrangement as claimed in claim 34, wherein the pivoting bearing of the spring is adapted to move along a surface of the contact mount, and is limited only by a sliding core.

57. The switching contact arrangement as claimed in claim 34, wherein a first end limb of the spring is bent, and is adapted to rest in a recess arranged on the contact lever.

58. The switching contact arrangement of claim 1, wherein the contact force spring is arranged to pivot like a rocker.

59. The switching contact arrangement of claim 21, wherein the means for exerting a force is arranged to pivot like a rocker.

60. The switching contact arrangement of claim 29, wherein the means for exerting a force is arranged to pivot like a rocker.

61. The switching contact arrangement of claim 34, wherein the spring is arranged to pivot like a rocker.

* * * * *